US009628888B2

(12) United States Patent
Hayashida

(10) Patent No.: US 9,628,888 B2
(45) **Date of Patent: *Apr. 18, 2017**

(54) OPEN-AIR EARBUDS AND METHODS FOR MAKING THE SAME

(71) Applicant: Apple Inc., Cupertino, CA (US)

(72) Inventor: Jeffrey Y. Hayashida, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 82 days.

This patent is subject to a terminal disclaimer.

(21) Appl. No.: 14/163,616

(22) Filed: Jan. 24, 2014

(65) Prior Publication Data

US 2014/0140566 A1 May 22, 2014

Related U.S. Application Data

(63) Continuation of application No. 13/250,973, filed on Sep. 30, 2011, now Pat. No. 8,638,971.

(51) Int. Cl.

| | |
|---|---|
| ***H04R 25/00*** | (2006.01) |
| ***H04R 1/10*** | (2006.01) |
| *H04R 31/00* | (2006.01) |

(52) U.S. Cl.

CPC ..... *H04R 1/10* (2013.01); *H04R 1/1016* (2013.01); *H04R 1/1058* (2013.01); *H04R 31/00* (2013.01); *H04R 31/006* (2013.01); *Y10T 29/49005* (2015.01)

(58) Field of Classification Search

USPC ..... 381/72, 338, 330, 337, 395

See application file for complete search history.

(56) References Cited

U.S. PATENT DOCUMENTS

| | | | | |
|---|---|---|---|---|
| 4,742,887 | A * | 5/1988 | Yamagishi | 181/129 |
| 6,880,193 | B2 | 4/2005 | Figg et al. | |
| 8,532,325 | B2 * | 9/2013 | Tung et al. | 381/380 |
| 2003/0176164 | A1 * | 9/2003 | Hefetz | H04B 1/3838 455/3.06 |
| 2008/0013774 | A1 | 1/2008 | Hosaka et al. | |
| 2009/0233652 | A1 | 9/2009 | Yang | |
| 2012/0087531 | A1 | 4/2012 | Hankey et al. | |

FOREIGN PATENT DOCUMENTS

| | | |
|---|---|---|
| DE | 202005007074 | 7/2005 |
| EP | 1879424 | 1/2008 |

* cited by examiner

*Primary Examiner* — Amir Etesam

(74) *Attorney, Agent, or Firm* — Van Court & Aldridge LLP

(57) ABSTRACT

Open-air earbuds and methods for making the same are disclosed. The earbud has a neck, which is open to the ambient environment in order to improve bass response. In order to prevent debris from entering the interior of the earbud, a filter is incorporated into the neck.

27 Claims, 5 Drawing Sheets

OPEN-AIR EARBUDS AND METHODS FOR MAKING THE SAME

CROSS-REFERENCE TO RELATED APPLICATIONS

This application is a continuation of U.S. patent application Ser. No. 13/250,973 filed on Sep. 30, 2011 (now U.S. Pat. No. 8,638,971). The disclosure of this application is hereby incorporated by reference in its entirety.

BACKGROUND

Headsets are commonly used with portable electronic devices such as portable music players and mobile phones. Headsets can include non-cable components such as a jack, headphones, and/or a microphone and one or more cables that interconnect the non-cable components. Other headsets can be wireless. The headphones—the components that generate sound—can exist in many different form factors, such as over-the-ear headphones or as in-the-ear or in-the-canal earbuds. In-the-ear earbuds are sometimes referred to as non-occluding earbuds as they generally do not form an airtight seal with the user's ear. Ear buds can also be open or closed to the ambient environment. Open-air earbuds generally have better acoustic performance than closed-air earbuds. However, debris can enter open-air earbuds and damage the earbud components. Accordingly, what is needed is an earbud that is open to the ambient environment while protecting the interior of the earbud.

SUMMARY

Open-air earbuds and methods for making the same are disclosed. The earbud can include a housing with an internal volume and a hollow neck member, which are open to the ambient environment to improve acoustic performance. A filter may be incorporated into the hollow neck member and can include a number of through holes that are designed to prevent debris from entering the interior of the earbud while maintaining the open-air connection between the internal volume of the housing and the ambient environment. The filter may be part of a neck subassembly, which can also include inner and outer sleeve members that define an internal sleeve volume that is open to the ambient environment. In some embodiments, the filter is formed from a stainless steel disk that is chemically etched to have a number of through holes of a predetermined size. In other embodiments, an acoustic mesh filter can be incorporated into the neck of the earbud.

According to some embodiments, the filter can be incorporated into the hollow neck member by press fitting. In those embodiments, the neck subassembly can then be coupled to the neck member in any suitable fashion, including press fitting or using an adhesive. In other embodiments, the neck subassembly can be capped with the filter and then the entire filter-subassembly member can be coupled to the neck member. In embodiments in which the filter is an acoustic mesh, the filter can be insert molded into a plastic sleeve prior to being incorporated into the hollow neck member.

BRIEF DESCRIPTION OF THE DRAWINGS

The above and other aspects and advantages of the invention will become more apparent upon consideration of the following detailed description, taken in conjunction with accompanying drawings, in which like reference characters refer to like parts throughout, and in which.

DETAILED DESCRIPTION OF THE DISCLOSURE

Headphones or earbuds for use in headsets are disclosed. Earbuds according to some embodiments include a neck portion that is open to the ambient environment to improve acoustic performance. A filter can be incorporated into the neck and may be designed to protect the interior of the earbuds without degrading the acoustic performance of the earbuds.

Figure 1:
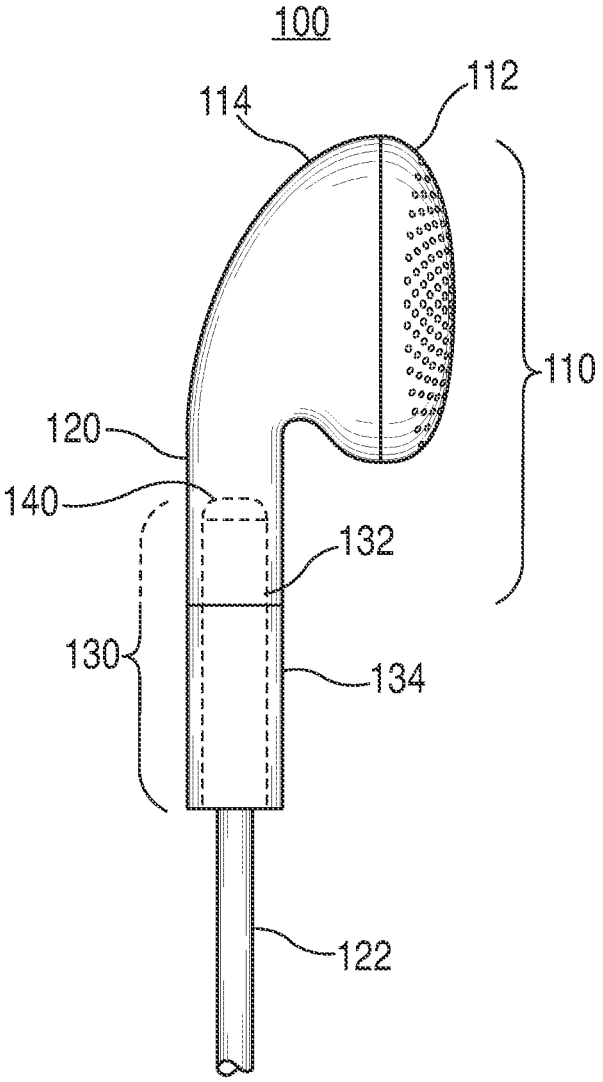
FIG. 1 shows an illustrative view of an earbud in accordance with an embodiment of the invention.

FIG. 1 shows an illustrative view of earbud 100 in accordance with some embodiments. In particular, FIG. 1 shows a side view of earbud 100, including housing 110, which can include front non-occluding member 112, back non-occluding member 114, and hollow neck member 120, cable 122, neck subassembly 130, which includes inner sleeve 132 and outer sleeve 134, and filter 140. Filter 140 and inner sleeve 132 are displayed in phantom. Earbud 100 can also include one or more speakers and a printed circuit board (none of which are shown).

Housing 110 may be designed to fit in the ear of a user in a non-occluding manner. Non-occluding earbuds are generally designed to not form an airtight seal between the ear (or ear canal) and the outer surface of the earbud. By way of contrast, occluding earbuds are generally designed to fit inside of the user's ear canal and form a substantially airtight seal. The absence of an airtight seal may require that a portion the earbud be open to the air to improve acoustic performance. Although non-occluding earbuds are generally disclosed herein, open neck headphones according to embodiments of the invention may be adapted for use with any type of headphone.

Housing 110 can include front non-occluding member 112 and back non-occluding member 114, which may be coupled together and cosmetically finished to provide the illusion that it is a single piece construction. The two-part construction of housing 110 is useful so that a speaker subassembly (e.g., an assembly including speakers and circuitry) can be installed in earbud 100.

In some embodiments, cable 122 extends from circuitry inside housing 110, through hollow neck member 120 and neck subassembly 130. The hollow areas within housing 110 and hollow neck member 120 can define an interior volume. Similarly, the hollow area within neck subassembly 130 can define a sleeve volume. Filter 140 can be incorporated into hollow neck member 120 to prevent debris from entering the interior of housing 110, as well as to acoustically couple the interior and sleeve volumes and allow them to be open to the ambient environment. Filter 140 may be designed, as discussed in more detail below, to provide the best balance between acoustic performance and protection of the interior of the earbud.

In some embodiments, filter 140 may be incorporated into hollow neck member 120 prior to the introduction of neck subassembly 130. In these embodiments, filter 140 can be pressed into place and then neck subassembly 130 can be fit into hollow neck member 120. In other embodiments, inner sleeve 132 can be capped with filter 140 and then the entire neck subassembly 130 can be coupled to hollow neck member 120.

Inner sleeve 132 and outer sleeve 134 may be distinct sleeve members coupled together, or alternatively, the sleeves may be formed as one unitary neck subassembly, for example, using an insert or compression molding process. The outer surface of inner sleeve 132 can be coupled to the inner surface of hollow neck member 120 in any suitable manner. For example, inner sleeve 132 may be press fit securely inside hollow neck member 120 or coupled to hollow neck member 120 with an adhesive. Outer sleeve 134 may be proportioned such that its outer diameter matches the outer diameter of hollow neck member 120, giving the entire neck assembly an aesthetically pleasing and seamless appearance.

Figure 2:
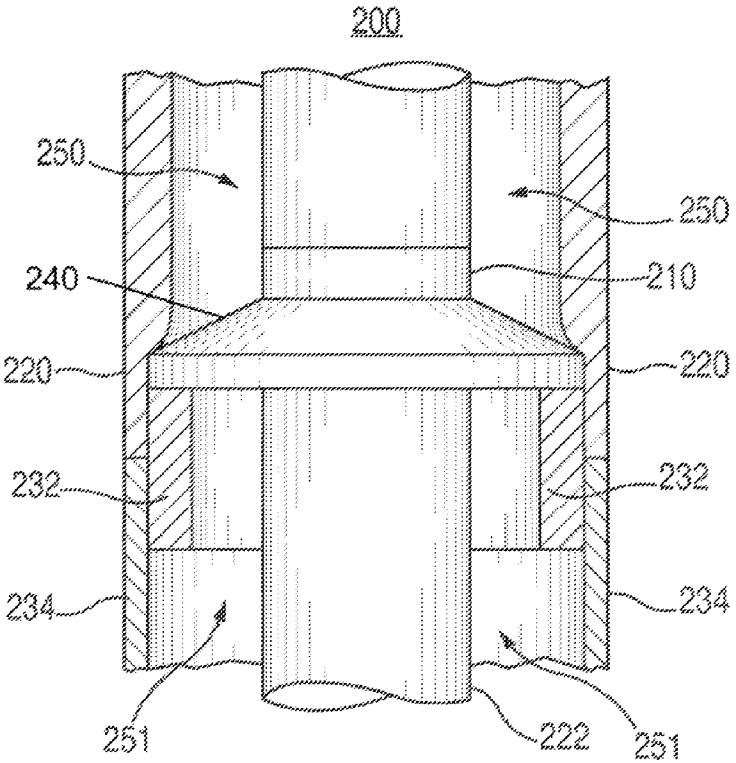
FIG. 2 shows an illustrative cross-sectional view of the neck of the earbud of FIG. 1 in accordance with an embodiment of the invention.

FIG. 2 shows a cross-sectional view of neck assembly 200 of the earbud shown in FIG. 1 in accordance with some embodiments. Cable 222 can extend through assembly 200 from the interior of housing 210 to an electronic device (neither of which are shown). Filter 240 is incorporated inside hollow neck member 220, which, according to some embodiments, can have a tapered inner surface that transitions from a first inner diameter to a second inner diameter to prevent filter 240 from sliding out of hollow neck member 220. The neck subassembly (i.e., inner sleeve 232 and outer sleeve 234) can be coupled to hollow neck member 220 such that the outer surface of inner sleeve 232 is secured to the inner surface of hollow neck member 220 and the top of outer sleeve 234 is coupled to inner sieve 232 and abuts the bottom, or distal end, of hollow neck member 220. Additionally, outer sleeve 234 and hollow neck member 220 can have the same outer diameter so that neck assembly 200 has an aesthetically pleasing, seamless appearance. Neck assembly 200 may include interior volume 250, which is open to the ambient environment through filter 240 and sleeve volume 251.

Hollow neck member 220, inner sleeve 232, and outer sleeve 234 can be made of any suitable materials. In some embodiments, hollow neck member 220 and inner sleeve 232 can be made of plastic, and outer sleeve 234 can be made of rubber. A rubber outer sleeve 234 may help to prevent cable 222 from chafing against a resilient outer sleeve material. In other embodiments, all three components can be made of plastic, or other resilient material. In those embodiments, outer sleeve 234 and hollow neck member 220 can be ultrasonically welded, sanded, and polished to produce a neck assembly with a seamless, unibody appearance. Details of an ultrasonic welding process for earbuds can be found in commonly-assigned U.S. Publication No. 2012/0087531, which is incorporated by reference herein in its entirety.

Figure 3:
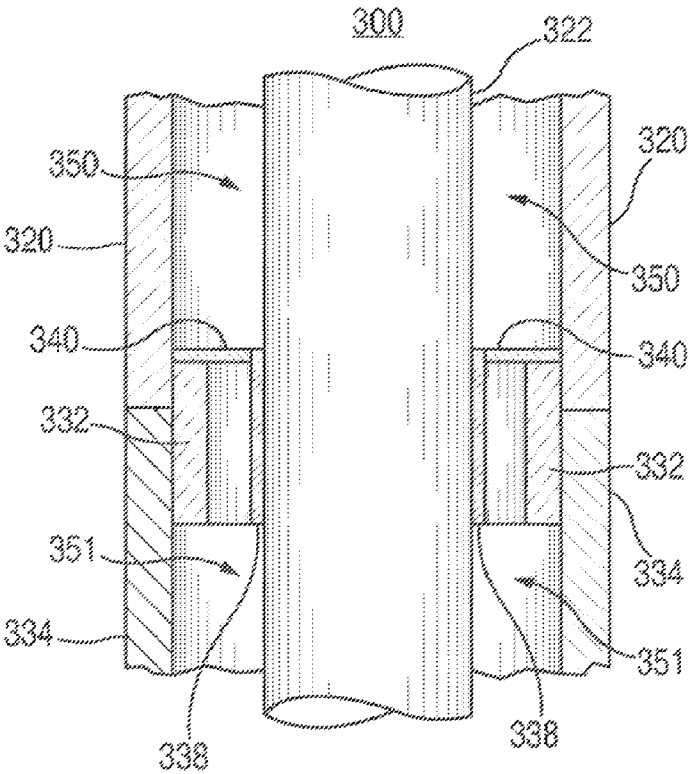
FIG. 3 shows an illustrative cross-sectional view of the neck of an earbud in accordance with an embodiment of the invention.

FIG. 3 shows a cross-sectional view of neck assembly 300 in accordance with some embodiments. Cable 322 can extend through assembly 300 from the interior of an earbud to an electronic device (neither of which are shown). The neck subassembly (i.e., inner sleeve 332, including cable engagement member 338, and outer sleeve 334) can be coupled to hollow neck member 320 such that the outer surface of inner sleeve 332 is secured to the inner surface of hollow neck member 320 and the top of outer sleeve 334 is coupled to inner sleeve 332 and the bottom, or distal end, of hollow neck member 320. Acoustic mesh filter 340 can abut the top of inner sleeve 332 as described below with respect to FIGS. 5 and 6. Additionally, outer sleeve 334 and hollow neck member 320 can have the same outer diameter so that neck assembly 300 has an aesthetically pleasing, seamless appearance. Neck assembly 300 may include interior volume 350, which is open to the ambient environment through filter 340 and sleeve volume 351.

Hollow neck member 320, inner sleeve 332, and outer sleeve 334 can be made of any suitable materials. In some embodiments, hollow neck member 320 and inner sleeve 332 can be made of plastic and outer sleeve 334 can be made of rubber. A rubber outer sleeve 334 may help to prevent cable 322 from being damaged from chafing against the edge of a resilient outer sleeve material. In other embodiments, all three components can be made of plastic, or other resilient material. In those embodiments, outer sleeve 334 and hollow neck member 320 can be ultrasonically welded, sanded, and polished to produce a neck assembly with a seamless, unibody appearance.

Figure 4:
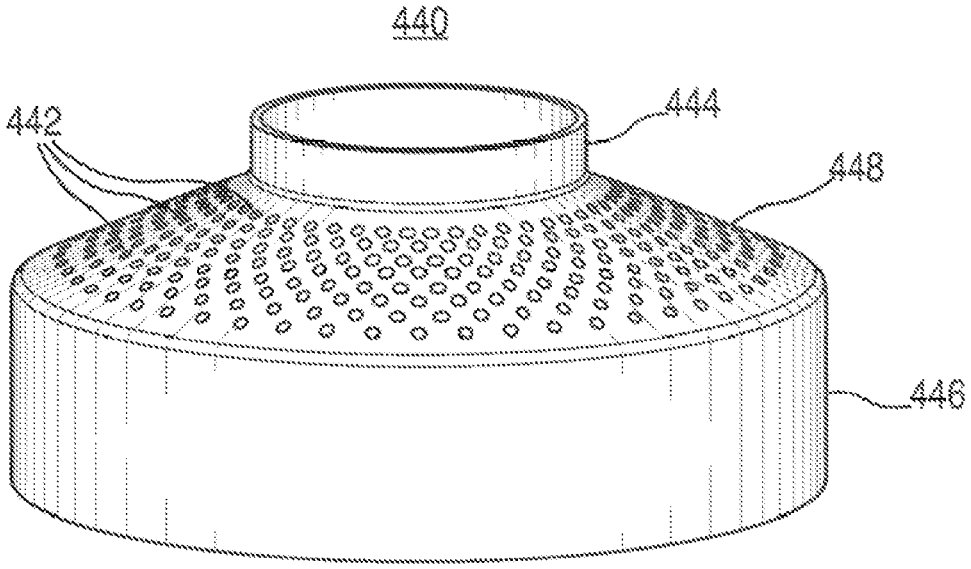
FIG. 4 shows a perspective view of a filter in accordance with an embodiment of the invention.

FIG. 4 shows a perspective view of filter 440 for use in the neck of an earbud in accordance with some embodiments. Filter 440 may correspond to, for example, filter 140 of FIG. 1, and can include through holes 442, cable stabilization region 444, sleeve engagement region 446, and acoustic coupling region 448. The inner diameter of the cylinder-shaped cable stabilization region 444 can be equal to the outer diameter of cable 222 (see FIG. 2) to prevent debris from passing through a gap between cable stabilization region 444 and cable 222. Likewise, the outer diameter of the cylinder-shaped sleeve engagement region 446 can be equal to the inner diameter of hollow neck member 220. Acoustic coupling region 448 can extend radially from a proximal end of cable stabilization region 444 to a proximal end of sleeve engagement region 446 with a predetermined angle of declination. The angle of declination can be chosen to optimize the number and size of through holes 442 in acoustic coupling region 448.

In some embodiments, filter 440 is formed from a stainless steel disc or other suitable material (e.g., plastic). A number of through holes 442 of a predetermined diameter (e.g., 0.75 microns) can be created in the disc, for example, to acoustically couple an interior volume of an earbud to a sleeve volume of a neck subassembly. The size of through holes 442 may be chosen to provide the best balance between acoustic performance and protection of the interior of the earbud. In some embodiments, photoresist can be applied to both sides of the disc. A desired hole pattern can subsequently be imaged in the photoresist using a mask. After the photoresist is developed, a chemical etching process can then be used to etch through holes 442 into the disc.

Filter 440 can have a frusto-conical shape as depicted in the embodiment shown in FIG. 4. The disc may be stamped or molded in one or more steps to achieve a shape similar to that of filter 440. In some embodiments, filter 440 can be molded in one piece with through holes 442 created during the molding process. For example, the mold can include a number of protrusions such that through holes 442 are formed during the molding process. Any suitable shape may be chosen for filter 440; however, a design that maximizes the volume of air within neck assembly 200 and air flow through filter 440 also results in optimal acoustic performance.

Figure 5:
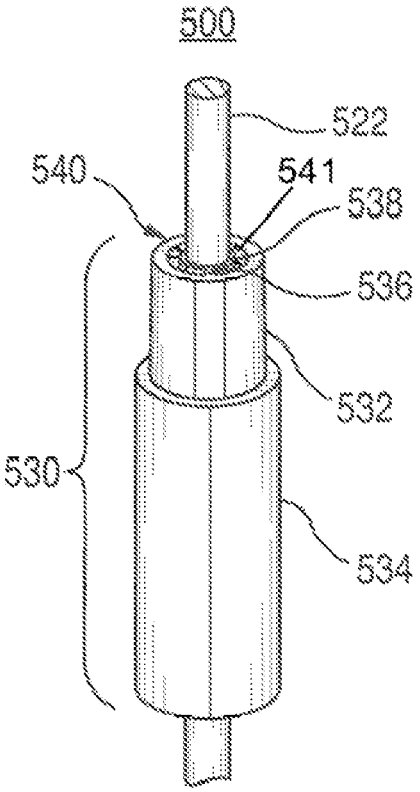
FIGS. 5 and 6 show illustrative views of earbud neck subassemblies in accordance with embodiments of the invention.
Figure 6:
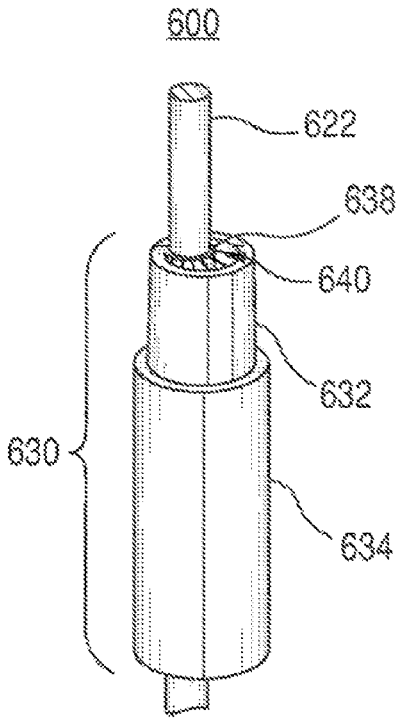

FIGS. 5 and 6 show illustrative views of earbud neck subassembly sections 500 and 600 in accordance with some embodiments. Neck subassembly section 500 can be coupled to the hollow neck member of an earbud (e.g., hollow neck member 120 of FIG. 1). According to some embodiments, neck subassembly section 500 can include cable 522 and neck subassembly 530, which can include inner sleeve 532, outer sleeve 534, inner sleeve bridge 536, cable engagement member 538, and filter retaining region 541. Acoustic mesh filter 540 can be coupled to filter retaining region 541 as described below. Neck subassembly 530 may be formed as a single member, with inner sleeve 532 and outer sleeve 534 formed monolithically. Alternatively, inner sleeve 532 and outer sleeve 534 can be two distinct members. In the latter embodiments, the sleeves may be coupled together with an adhesive or by press fitting inner sleeve 532 inside outer sleeve 534. In some embodiments, inner sleeve 532 can be made of plastic and outer sleeve 534 can be made of rubber. A rubber outer sleeve 534 may help to prevent cable 522 from chafing against the edge a resilient outer sleeve material.

Inner sleeve 532 can include cable engagement member 538. In general, cable engagement member 538 couples neck subassembly 530 to cable 522 while maintaining an air gap between at least part of the outer surface of cable engagement member 538 and the inner surface of inner sleeve 532. In some embodiments, cable engagement member 538 is compressively coupled to cable 522; however, any suitable method of coupling can be used.

FIGS. 5 and 6 represent two possible embodiments for securing a cable engagement member to an inner sleeve. As shown in FIG. 5, inner sleeve bridges 536 connect cable engagement member 538 to inner sleeve 532. Although only one inner sleeve bridge is shown in FIG. 5, more than one inner sleeve bridge can be included to improve the structural integrity of neck subassembly section 500. In the embodiment depicted in FIG. 6, neck subassembly section 600 can include cable 622 and neck subassembly 630, which can include inner sleeve 632, outer sleeve 634, cable engagement member 638, and acoustic mesh filter 640 can be coupled to a filter retaining region. As shown, cable engagement member 638 is coupled to the inner surface of inner sleeve 632 along a section of its outer perimeter, such that the center axis of inner sleeve 632 and the center axis of cable engagement member 638 are offset with respect to each other. In the embodiments shown in FIGS. 5 and 6, the inner sleeve and cable engagement member can be integrally formed (e.g., by injection or compression molding).

Acoustic mesh filter 540, or another suitable filter (e.g., filter 440 of FIG. 4) can be coupled to filter retaining region 541, which is adjacent to the top end of inner sleeve 532 (i.e., the end of inner sleeve 532 that is inserted into the hollow neck member of an earbud) in any suitable manner. For example, acoustic mesh filter 540 may be coupled to the top end of inner sleeve 532 with an adhesive. Alternatively, acoustic mesh filter 540 can be insert molded into a plastic sleeve and inserted into the hollow neck member of an earbud (neither of which are shown). Acoustic mesh filter 540 can consist of any suitable mesh material, including, but not limited to, plastic, metal, nylon, or any other natural or synthetic fiber. The material and mesh pitch can be chosen to provide the best acoustic performance while maintaining the interior of the earbud free from debris.

Earbuds according to embodiments of the invention can be included as part of a headset such as a wired headset or a wireless headset. An example of a wired headset is discussed below in connection with the description accompanying FIG. 7. A wireless headset can include, for example, a Bluetooth headset.

Figure 7:
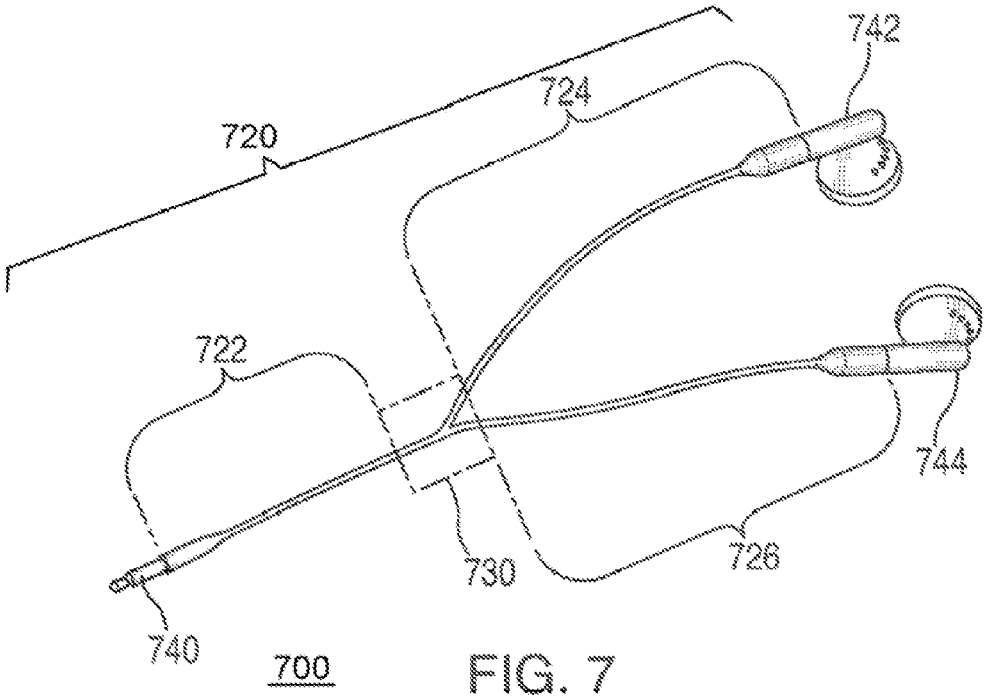
FIG. 7 shows an illustrative view of a wired headset in accordance with embodiments of the invention.

FIG. 7 shows an illustrative headset 700 having cable structure 720 that integrates with non-cable components 740, 742, and 744. For example, non-cable components 740, 742, and 744 can be a male plug, left headphones, and right headphones, respectively. As a specific example, components 742 and 744 can be an earbud having one or more pressure sensors mounted on or in the housing. Cable structure 720 has three legs 722, 724, and 726 joined together at bifurcation region 730. Leg 722 may be referred to herein as main leg 722, and includes the portion of cable structure 720 existing between non-cable component 740 and bifurcation region 730. Leg 724 may be referred to herein as left leg 724, and includes the portion of cable structure 720 existing between non-cable component 742 and bifurcation region 730. Leg 726 may be referred to herein as right leg 726, and includes the portion of cable structure 720 existing between non-cable component 744 and bifurcation region 730.

Cable structure 720 can include a conductor bundle that extends through some or all of legs 722, 724, and 726. Cable structure 720 can include conductors for carrying signals from non-cable component 740 to non-cable components 742 and 744 and vise versa. For example, signals from non-cable component 740 to non-cable components 742 and 744 can be audio signals. Signals from non-cable components 742 and 744 to non-cable component 740 can be pressure signals. Cable structure 720 can include one or more rods constructed from a superelastic material. The rods can resist deformation to reduce or prevent tangling of the legs. The rods are different than the conductors used to convey signals from non-cable component 740 to non-cable components 742 and 744, but share the same space within cable structure 720. Several different rod arrangements may be included in cable structure 720.

Figure 8:
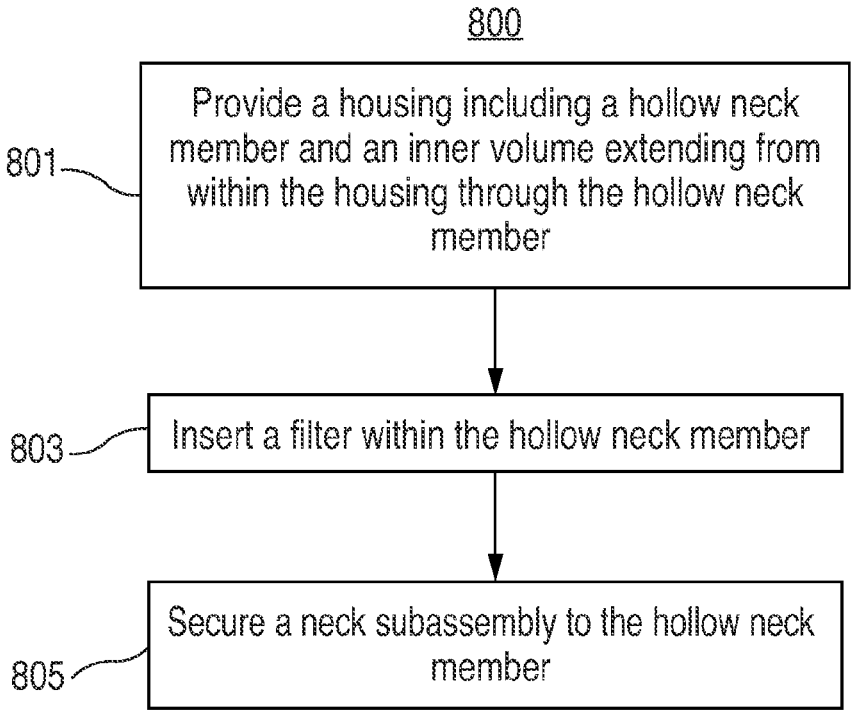
FIGS. 8 and 9 show illustrative processes for assembling earbuds in accordance with embodiments of the invention.

FIG. 8 is a flowchart of process 800 for assembling an open-air earbud. In step 801, a housing is provided that includes a hollow neck member and an inner volume extending from within the housing through the hollow neck member. For example, the housing and hollow neck member could be housing 110 and hollow neck member 120 of FIG. 1. At step 803, a filter (e.g., filter 440) can be inserted within the hollow neck member. The hollow neck member may have a tapered inner diameter that prevents the filter from sliding beyond the end of the hollow neck member. At step 805, a neck subassembly (e.g., neck subassembly 130) can be secured to the hollow neck member, for example, using an adhesive or press fitting.

Figure 9:
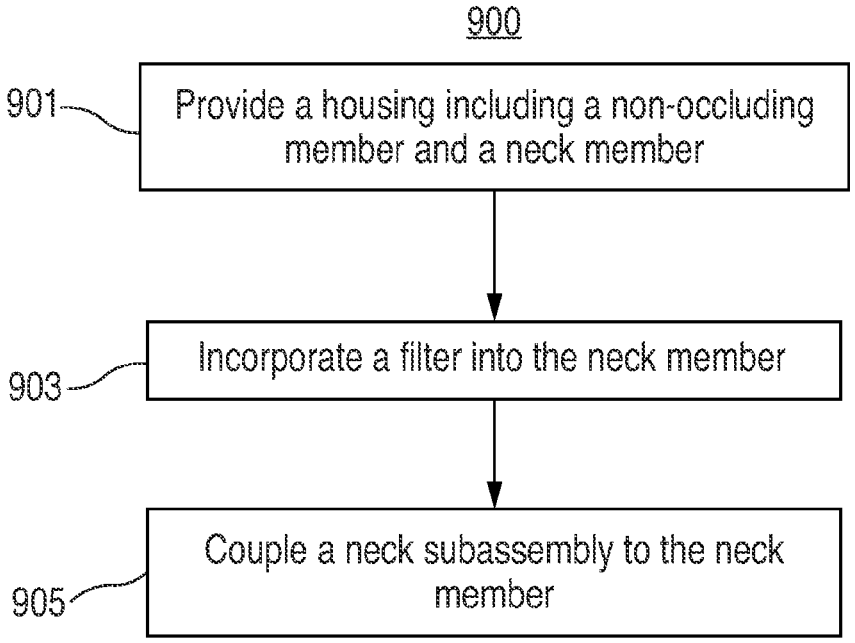

FIG. 9 is a flowchart of process 900 for assembling an open-air earbud. In step 901, a housing is provided that includes a non-occluding member and a neck member. For example, the non-occluding member could be the part of earbud 100 that includes front non-occluding member 112 and back non-occluding member 114. At step 903, a filter (e.g., filter 440 or acoustic mesh filter 540) can be incorporated into the neck member. In some embodiments, the filter can be coupled to a filter retaining region of a neck subassembly (e.g., with an adhesive or by press fitting) prior to being incorporated into the neck member. For example, the filter can be insert molded into the neck subassembly before being inserted into the neck member. In other embodiments, the filter can be incorporated into the neck member prior to step 905, in which a neck subassembly (e.g., neck subassembly 130) can be coupled to the neck member, for example, using an adhesive or press fitting.

It is understood that the steps shown in methods 800 and 900 of FIGS. 8 and 9 are merely illustrative and that existing steps may be modified or omitted, additional steps may be added, and the order of certain steps may be altered.

While there have been described pressure sensing earbuds and systems and methods for the use thereof, it is to be understood that many changes may be made therein without departing from the spirit and scope of the invention. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The described embodiments of the invention are presented for the purpose of illustration and not of limitation.

What is claimed is:

1. An earbud comprising:
a housing defining an interior volume;
a filter; and
a cable extending from within the interior volume, through the filter, and into an ambient environment, wherein:
the filter comprises at least one through-hole that acoustically couples the internal volume and the ambient environment;
the cable extends through an opening defined by an inner diameter of the filter; and
the inner diameter of the filter is equal to an outer diameter of the cable to prevent a gap between the inner diameter of the filter and the outer diameter of the cable.

2. The earbud of claim 1, wherein:
the housing comprises a first housing member and a hollow neck member;
the internal volume extends from the first housing member into the hollow neck member; and
the filter is secured within the hollow neck member.

3. The earbud of claim 2, wherein an outer diameter of the filter is equal to an inner diameter of the hollow neck member to prevent a gap between the outer diameter of the filter and the inner diameter of the hollow neck member.

4. The earbud of claim 2, wherein:
the earbud further comprises a cable engagement member;
the cable extends through an opening in the cable engagement member;
the opening is defined by an inner surface of the cable engagement member; and
the filter covers an air gap between at least a part of an outer surface of the cable engagement member and an inner surface of the hollow neck member.

5. The earbud of claim 4, wherein a center axis of the cable engagement member is offset from a center axis of the hollow neck member.

6. The earbud of claim 4, wherein a center axis of the cable engagement member is aligned with a center axis of the hollow neck member.

7. The earbud of claim 1, further comprising circuitry within the interior volume, wherein one end of the cable is coupled to the circuitry.

8. The earbud of claim 1, wherein the filter comprises a plurality of through-holes that acoustically couple the internal volume and the ambient environment.

9. A method for assembling an earbud, comprising:
providing a housing with an interior volume;
incorporating a filter into the housing; and
routing a cable from within the interior volume, through the filter, and into an ambient environment, wherein:
the incorporated filter comprises at least one through-hole that acoustically couples the internal volume and the ambient environment; and
the at least one through-hole of the filter prevents debris from entering the internal volume from the ambient environment.

10. The method of claim 9, wherein:
the housing comprises a non-occluding member and a neck member; and
the at least one through-hole of the filter is configured to prevent debris from the ambient environment from entering the interior volume.

11. The method of claim 10, further comprising coupling to the neck member a neck subassembly comprising a cable engagement member positioned within a sleeve, wherein the filter covers an air gap between at least a part of the cable engagement member and the sleeve.

12. The method of claim 11, wherein the routing further comprises routing the cable through an opening in the cable engagement member.

13. An earbud comprising:
a housing defining an interior volume;
a filter;
a cable extending from within the interior volume, through the filter, and into an ambient environment;
a neck subassembly defining a sleeve volume that is open to the ambient environment, wherein the neck subassembly is coupled to the housing; and
a cable stabilization region positioned within the internal volume and operative to pass the cable through an opening defined by an inner diameter of the cable stabilization region, wherein the filter is secured to the housing within the internal volume, wherein the filter acoustically couples the internal volume and the sleeve volume, and wherein at least a portion of the filter covers an air gap between at least a part of the cable stabilization region and the housing.

14. The earbud of claim 13, wherein:
the neck subassembly comprises an inner sleeve and an outer sleeve;
the inner sleeve is secured to an inner surface of the housing; and
the outer sleeve is coupled to the inner sleeve and a portion of the housing.

15. The earbud of claim 14, wherein the filter comprises:
the cable stabilization region defined by a hollow cylinder having a height, a base, an inner diameter, and an outer diameter;
an acoustic coupling region integrated with the base of the cable stabilization region and extending from the base; and
a sleeve engagement region integrated with the acoustic coupling region.

16. The earbud of claim 15, wherein the acoustic coupling region extends radially a predetermined distance from the base at a predetermined angle of declination with respect to a plane perpendicular to a center axis of the filter and parallel to the base.

17. The earbud of claim 16, wherein the sleeve engagement region is defined by a ring having a height, an inner diameter, and an outer diameter.

18. The earbud of claim 16, wherein:

the housing comprises a first housing member and a hollow neck member;

the internal volume of the housing extends from the first housing member into the hollow neck member;

the filter is secured within the hollow neck member;

the inner sleeve is secured to an inner surface of the hollow neck member; and the outer sleeve is coupled to the inner sleeve and a portion of the hollow neck member.

19. The earbud of claim 18, wherein:

the filter comprises a plurality of through-holes that acoustically couple the internal volume and the sleeve volume; and the acoustic coupling region comprises the plurality of through-holes.

20. The earbud of claim 1, wherein the at least one through-hole both acoustically couples the internal volume and the ambient environment as well as prevents debris from entering the internal volume from the ambient environment.

21. The earbud of claim 13, wherein the inner diameter of the cable stabilization region is equal to an outer diameter of the cable to prevent a gap between the inner diameter of the cable stabilization region and the outer diameter of the cable.

22. The earbud of claim 1, wherein the filter is constructed from at least one of plastic, synthetic fibers, and natural fibers.

23. The earbud of claim 1, wherein the filter comprises stainless steel.

24. The earbud of claim 1, wherein the filter comprises a frusto-conical shape.

25. An earbud comprising:

a housing defining an interior volume;

a filter; and a cable extending from within the interior volume, through the filter, and into an ambient environment, wherein:

the filter comprises at least one through-hole that acoustically couples the internal volume and the ambient environment; and the filter comprises an acoustic mesh.

26. The earbud of claim 1, wherein the filter is configured to prevent debris from the ambient environment from entering the interior volume.

27. The earbud of claim 1, wherein the at least one through-hole comprises a diameter of 0.75 microns.

* * * * *